US005819479A

United States Patent [19]

Rodriguez-Ferre

[11] Patent Number: 5,819,479

[45] Date of Patent: Oct. 13, 1998

[54] MOUNTABLE PLAYHOUSE FOR CHILDREN TO PLAY

[76] Inventor: Jose Manuel Rodriguez-Ferre, Polg. Industrial Derramador - c/ Albacete s/n, 03440 IBI(Alicante), Spain

[21] Appl. No.: 759,982

[22] Filed: Dec. 3, 1996

[30] Foreign Application Priority Data

Dec. 7, 1995 [ES] Spain ..... 9503116 U

[51] Int. Cl.[6] ..... A63H 33/12

[52] U.S. Cl. ..... 52/79.4; 52/79.1; 52/79.9; 446/112; 446/478

[58] Field of Search ..... 52/79.1, 79.4, 52/79.5, 79.9, 79.13; 446/476, 478, 110, 112

[56] References Cited

U.S. PATENT DOCUMENTS

| | | | |
|---|---|---|---|
| 4,781,643 | 11/1988 | Holloway et al. | 446/476 X |
| 4,978,301 | 12/1990 | Dodge | 446/112 X |
| 5,069,650 | 12/1991 | Lehmann et al. | 446/476 |
| 5,121,710 | 6/1992 | Gonzalez | 446/476 X |
| 5,172,526 | 12/1992 | Morgan | 52/79.5 |
| 5,174,078 | 12/1992 | West | 446/110 X |
| 5,184,436 | 2/1993 | Sadler | 52/79.1 |
| 5,313,747 | 5/1994 | Sakihara | 446/478 X |
| 5,351,453 | 10/1994 | Leslie | 446/110 X |
| 5,487,241 | 1/1996 | Gorrell et al. | 52/79.1 |
| 5,498,188 | 3/1996 | Deahr | 446/478 X |
| 5,657,583 | 8/1997 | Tennant | 52/79.5 |

*Primary Examiner*—Christopher Kent
*Assistant Examiner*—Yvonne Horton-Richardson
*Attorney, Agent, or Firm*—Lackenbach Siegel Marzullo Aronson & Greenspan,P.C.

[57] ABSTRACT

A mountable toy for children comprising four modular facade parts (1) and two modular roof parts (2) of a moulded material, the parts (1) making contact through their upright sides, at joints (24) on either side of which there are holes (5) facing holes (4) in plates (3) lying over the joints (24). Parts (2) have holes (11) matching holes (10) at the ends of strips (9) which cross over the resulting joint (23). Parts (1) are provided with spherical heads (14) at their top which are housed in cavities (15) in parts (2), establishing a connection between the facade and the roof structures. The facade parts and roof parts embody a particular configuration which resembles a caricature, such as a mushroom.

3 Claims, 3 Drawing Sheets

MOUNTABLE PLAYHOUSE FOR CHILDREN TO PLAY

FIELD OF THE INVENTION

This invention relates to a toy, and more particularly to a toy playhouse.

SUMMARY OF THE INVENTION

The invention relates to a mountable playhouse for children to play with comprising modular facade parts made of a moulded material, interconnectable in succession to make up the structure of the playhouse enclosure, the inside of which is accessible for a child, and modular roof parts that are also interconnectable to make up a roof. The modular facade parts and the modular roof parts include connecting means obtained at the moulding stage proper which due to the resilient yield of the material establish a solid nexus between such elements, thereby to provide a stable and strong structure that may however be easily mounted and dismounted by an adult and is suitable for children to play.

The facade parts have openings conforming to window and door spaces, allowing a child into the living space.

The configuration of the modular facade and roof parts is such that they altogether make up a shape which resembles a caricature, such as a mushroom.

The structure may be conveniently be mounted and installed both indoors and outdoors. The components of the structure may be easily stored in a small enclosure which enables the same to be kept without taking up too much space.

No ancillary connecting means such as screws nor any tools whatsoever are required to mount the playhouse.

Two sheets of drawings are attached to the present specification for ease of explanation, showing an embodiment that is cited as an example.

DESCRIPTION OF THE PREFERRED EMBODIMENTS

Figure 1:
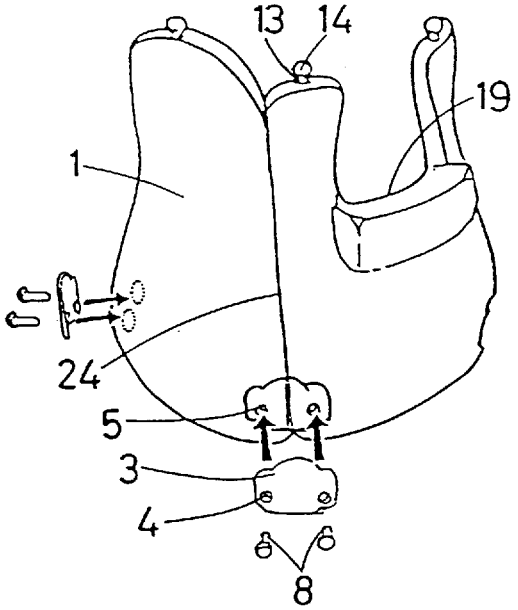
FIGS. 1 and 2 each illustrate a perspective view of two pairs of facade modules at the stage before their stable connection.
Figure 2:
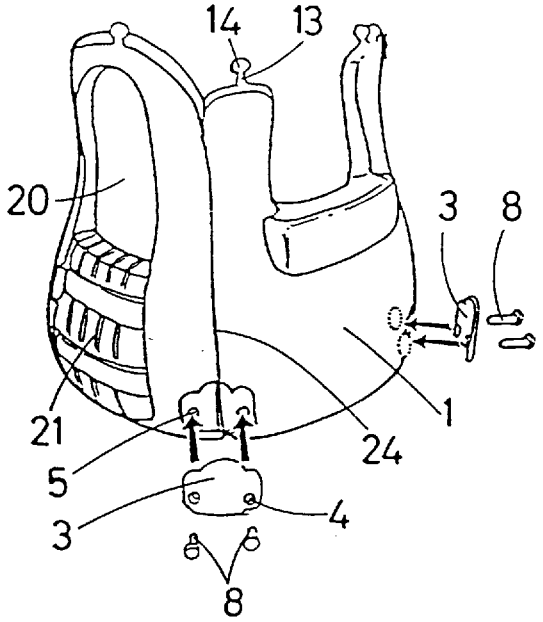
Figure 3:
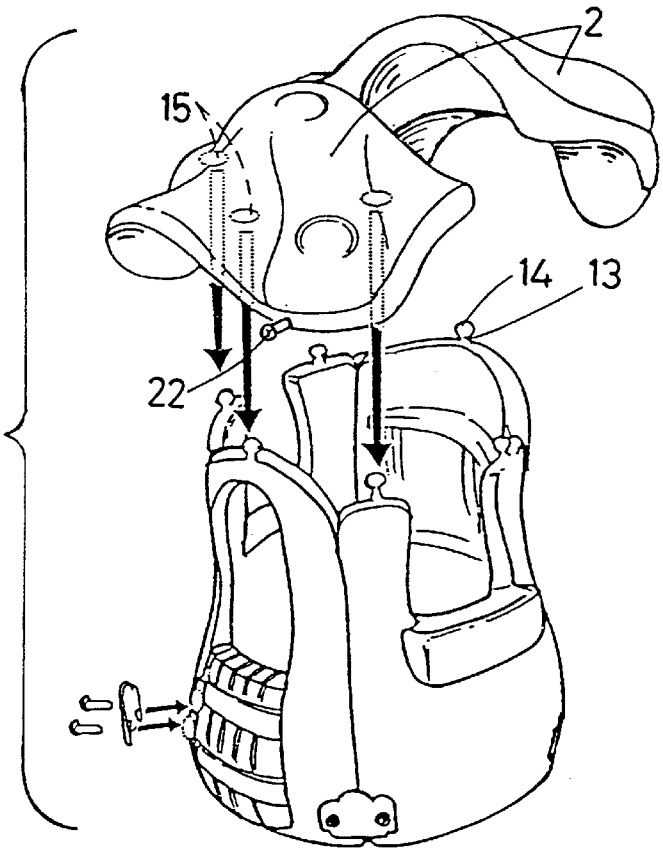
FIG. 3 is a perspective view of the facade structure after being assembled, the modular covering or roof being shown on top at the stage before being fitted on said facade.
Figure 4:
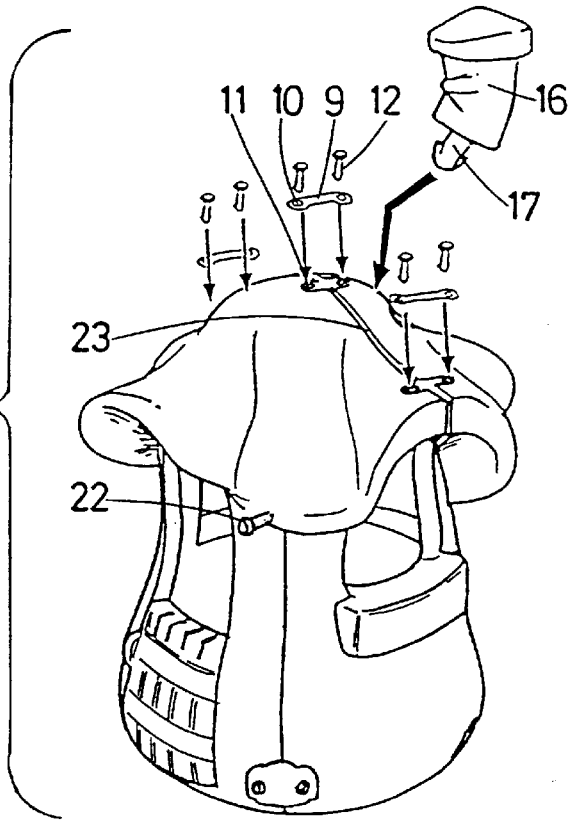
FIG. 4 is another perspective view showing the roof coupled onto the facade structure, and with the connecting means between both roof parts shown separately and exploded.
Figure 5:
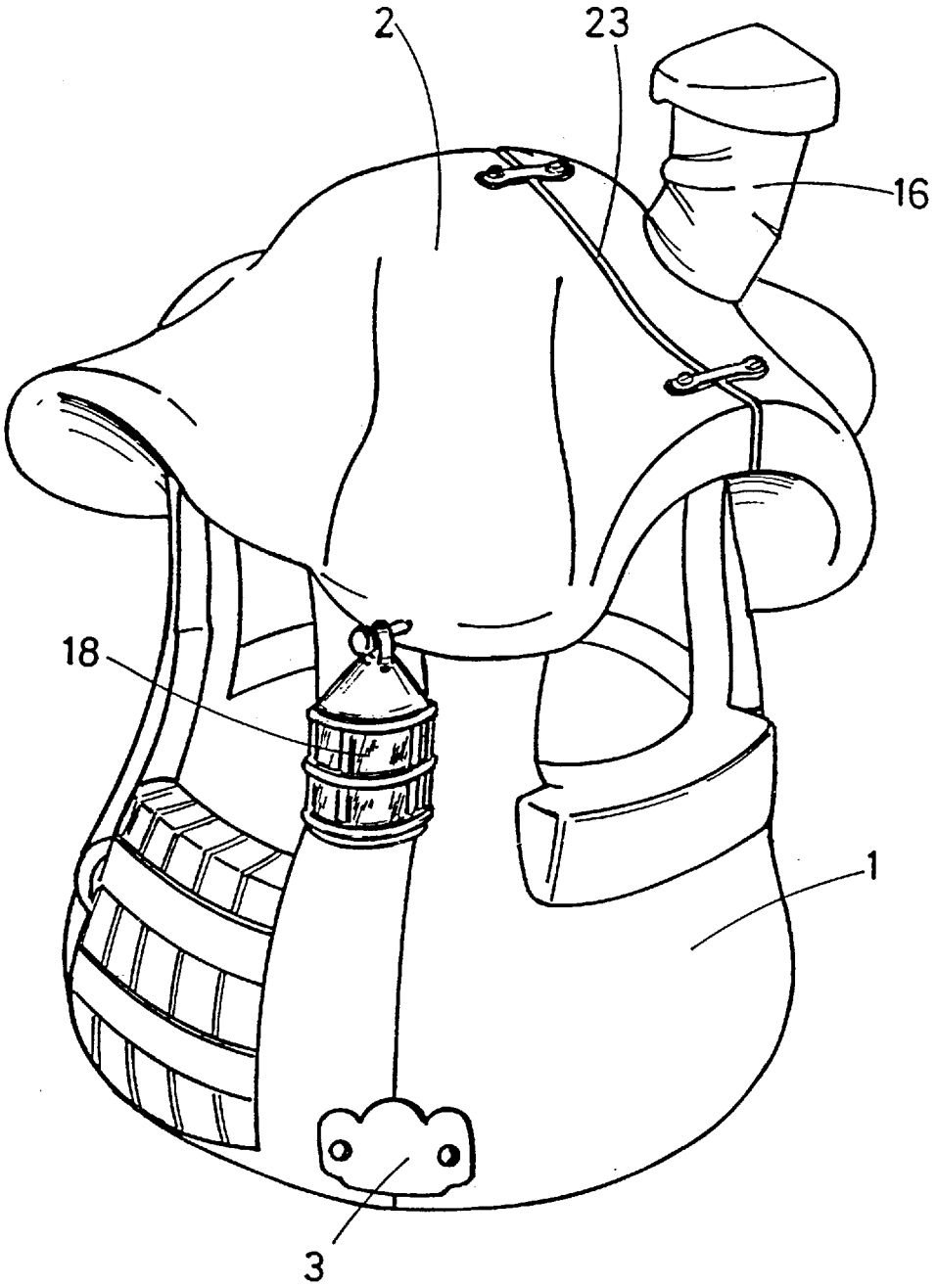
FIG. 5 is a perspective view of the playhouse, now assembled.

With reference to the figures, the latter show an embodiment of a mountable playhouse for-children to play comprising four modular facade parts -1- and two modular roof parts -2- made of a hard moulded material.

The facade parts -1-, which are upwardly elongated in shape, substantially dished at their lower middle portion and transversely curved, with their convexity towards the outside, establish contact through their sides, resulting in joints -24- having holes -5- on either side of their bottom portion that match with holes -4- located at the ends of oblong plates -3- that lie over said joints -24-. The facing holes -4- and -5- form female through holes or apertures for a pin -8- provided with a resilient spear-like head which, upon expanding, secures the connection.

Furthermore, the roof parts -2- have female holes -11- matching the bores -10- existing at the ends of strips -9- that cross over a joint -23- formed between the roof parts -2-. In this case, pins -12- which have a configuration equivalent to the pins -8-, secure the connection of parts roof -2-.

The top ends of the facade parts -1- have spigots -13- with a spherical snap-fastener head -14- that are housed in semi-spherical cavities -15- located on the underside of the roof parts -2- to establish a quick and easy connection between the facade structure and the roof structure resiliency when pressed into an aperture.

The facade parts -1- have window -19- and door -20- spaces where an articulated leaf -21- allows access into the playhouse and at the same time stands as a closure therefor.

Complementary parts, namely for instance a grotesque chimney -16-, are coupled to the roof by means of a short pin -17- that is snap fitted into a female hole in the roof, wherein it is retained due to the spear-like conforming end of said pin. Another complementary part, such as a lamp -18-, is hung from a salient -22- that projects from the eaves of one of the roof parts -2-.

I claim:

1. A mountable toy playhouse for children, in the shape of a caricature, comprising four modular facade parts and two modular roof parts, all made of a moulded material, the facade parts include a first connection means of laminar oblong plates of a strong material with an aperture at each end which match apertures that are located close to a lateral contacting edge of the facade parts, wherein each pair of facing holes establishes a female housing for receiving a spear-like resilient head through pin that tends to remain expanded, whereas the roof parts have a second connection means connectable along edges at the axis of symmetry of said contacting roof parts, said facade parts and said roof parts having a third connection means integrated therein in order to fabricate connection of the playhouse, whereby assembly and disassembly thereof is quick and easy, as no screws or tools are required.

2. A mountable toy playhouse for children, as in claim 1, wherein said second connection means for the roof parts comprise strips, each provided at their ends with perforated circular expansions, and said bores match female apertures lying close to the contacting sides of the roof parts and wherein each establishes female housings for respective through pins having an end spear-like resilient expansible head.

3. A mountable toy playhouse for children, as in claim 1, wherein said third means connecting said facade structure and the roof structure comprise spigots leading into a spherical extension which projects vertically from the top edge of the facade modules and are operatively arranged to be inserted, upon the material yielding resiliently, in semi-spherical cavities in the inner underside of the roof parts.

* * * * *